US005730661A

United States Patent [19]

Kozub

[11] Patent Number: 5,730,661

[45] Date of Patent: Mar. 24, 1998

[54] ARTICULATED PENDULUM PUTTER HAVING SIMPLIFIED CONSTRUCTION

[76] Inventor: Stanley S. Kozub, 6559 W. Maple Ave., Geneva, Ohio 44041

[21] Appl. No.: 703,552

[22] Filed: Aug. 27, 1996

[51] Int. Cl.[6] ..... A63B 53/00

[52] U.S. Cl. ..... 473/294; 473/313; 473/314; 473/316

[58] Field of Search ..... 473/294, 295, 473/312, 313, 314, 316, 321

[56] References Cited

U.S. PATENT DOCUMENTS

| | | | |
|---|---|---|---|
| 1,561,349 | 11/1925 | Murphy et al. | 473/295 |
| 2,092,839 | 9/1937 | Gouverneur | 473/203 |
| 2,801,106 | 7/1957 | Koehler | 473/295 X |
| 2,873,970 | 2/1959 | Murphey, Jr. . | |
| 2,938,728 | 5/1960 | Green . | |
| 3,089,525 | 5/1963 | Palmer . | |
| 3,170,690 | 2/1965 | Goranson et al. | 473/295 |
| 3,245,686 | 4/1966 | Hartmeister | 473/203 |
| 3,459,426 | 8/1969 | Sherwood | 473/201 |
| 3,663,019 | 5/1972 | Palotsee | 473/295 |
| 4,491,323 | 1/1985 | Kozub | 473/203 |
| 5,188,361 | 2/1993 | Coombe | 473/294 |
| 5,409,220 | 4/1995 | Lombardo | 473/313 X |
| 5,580,051 | 12/1996 | Fisker | 473/314 X |

*Primary Examiner*—William H. Grieb
*Attorney, Agent, or Firm*—Calfee, Halter & Griswold LLP; Sean T. Moorhead, Esq.

[57] ABSTRACT

An articulated pendulum putter is provided having first and second shaft sections connected by a simplified ball joint. The first shaft section carries a golf club putter head at its lower end. A pivot piece in sliding operative engagement with the shaft sections provides a pivoting joint between the two shaft sections. Preferably, the pivot piece is in direct sliding contact with the shaft section(s). The pivot piece can be spherical or can have at least one surface that is a zone of a sphere to contact the shaft section(s). The second shaft section, the pivot piece, and an upper portion of the first shaft section are wrapped by a grip, which also serves to maintain the shaft sections in sliding operative engagement with the pivot piece. Thus, two grip portions are defined—an upper grip and a lower grip—each of which is held by a hand of a golfer making a putt. While the hand holding the upper grip is held stationary, the other hand is used to swing the lower shaft section in pendulum fashion to strike an associated golf ball with the head of the putter.

18 Claims, 5 Drawing Sheets

ARTICULATED PENDULUM PUTTER HAVING SIMPLIFIED CONSTRUCTION

RELATED APPLICATIONS

The present invention is related to Application Ser. No. 586,132, now U.S. Pat. No. 4,491,323.

FIELD OF THE INVENTION

The present invention relates generally to golf clubs and, more specifically, to an articulated pendulum putter having a simplified ball joint between two pivotally mounted shaft sections.

BACKGROUND OF THE INVENTION

Various different prior art putters have been designed to increase the accuracy of the putting stroke of a golfer and to increase the comfort of the golfer while putting. Some of these different forms of putters have been constructed to function in the manner of an articulated pendulum putter having a shaft in two sections with a joint or pivot between the two sections. Examples of various different forms of articulated pendulum putters are disclosed in U.S. Pat. Nos. 1,561,349 to Murphy et al., 2,801,106 to Koehler, 3,170,690 to Goranson et al., and 5,188,361 to Coombe.

These prior art putters make use, to one degree or another, of complex milled parts and/or a complex assembly procedure. Most of these putters also have an exposed joint, which prevents the putter grip from having a smooth, uniform appearance. Accordingly, a need exists for an articulated pendulum-type putter with a simplified construction, yet whose structural and operational features may be used by substantially all golfers in order to improve upon their putting stroke. Another need exists for a putter that can be used two ways, either in a conventional style or as a pendulum-type putter.

SUMMARY OF THE INVENTION

According to the present invention, an articulated pendulum putter is provided having a simplified ball joint between two pivotally mounted shaft sections. A putter grip serves to physically annex and maintain the operative engagement of the simplified ball joint and the shaft sections.

Specifically, the putter of the present invention includes first and second shaft sections, with the first shaft section carrying a putter head at a lower end. The first shaft section is pivotally connected to the second shaft section at an upper end via a simplified ball joint. The simplified ball joint has a pivot piece, with the pivot piece having at least one surface that approximates a zone of a sphere in sliding operative engagement with the first shaft section, the second shaft section, or both the first and second shaft sections. Thus, the first and second shaft sections pivot relative to one another. A wrap, which is preferably a conventional grip, covers the pivot piece and at least a portion of the shaft section(s) in sliding operative engagement with the pivot piece, with the wrap maintaining the pivot piece in sliding operative engagement with the shaft section(s). Thus, no additional hardware is necessary to maintain the pieces in operative engagement.

In particular embodiments, the specific structure can have one or more additional limitations, including by way of example (a) the pivot piece comprising a sphere, (b) the wrap comprising or consisting of a grip that covers the upper end of the first shaft section, the pivot piece, and substantially the entire second shaft section, (c) the shaft sections comprising tubular members in sliding operative engagement with the pivot piece, and (d) the shaft sections comprising tubular members in direct sliding contact with the pivot piece.

It is therefore an advantage of the present invention to provide an articulated pendulum putter having a simplified construction.

It is a further advantage of this invention to provide an articulated pendulum putter having a simplified ball joint comprising a pivot piece in sliding operative engagement with two shaft sections and covered by a wrap, with the wrap serving to maintain the pieces in sliding operative engagement.

These and other advantages of the present invention will become more apparent from a detailed description of the invention.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to example the principles of this invention.

DETAILED DESCRIPTION OF THE PREFERRED EMBODIMENT

Figure 1:
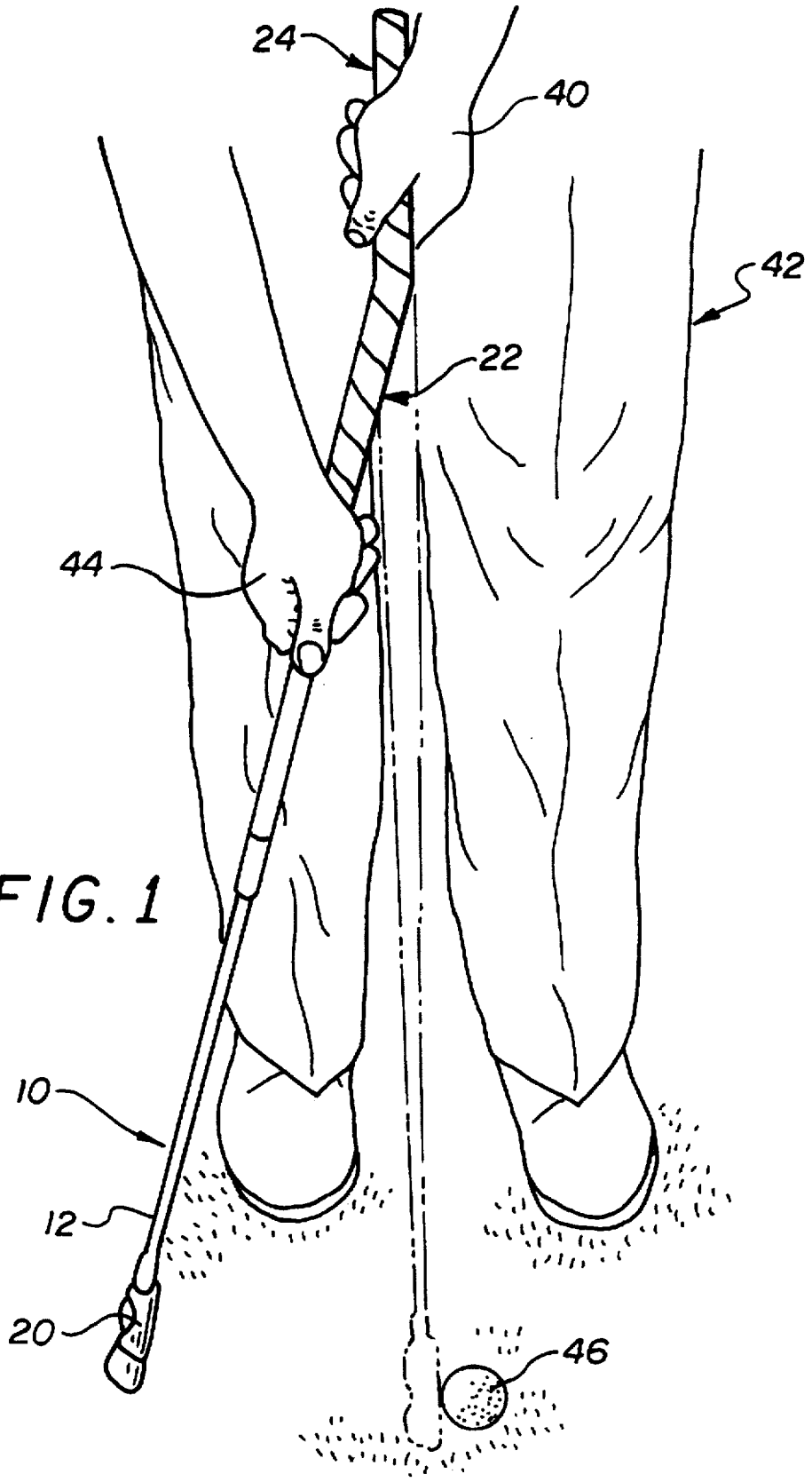
FIG. 1 is a perspective view of an articulated pendulum putter according to the present invention in use.

While the present invention will be described more fully hereinafter with reference to the accompanying drawings, in which a preferred embodiment of the present invention is shown, it is to be understood at the outset of the description that follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Referring now more particularly to the accompanying drawings, an articulated pendulum putter embodying the present invention is there shown and generally indicated at 10. As mentioned hereinabove, the putter 10 may include a first shaft section 12, a second shaft section 14, a pivot piece 16, and a wrap 18. The first shaft section 12 is downwardly tapered and is tubular in configuration. The upper end of the first shaft section 12 is wrapped by the wrap 18 and the lower end of the first shaft section 12 has a putter head 20 mounted thereon. The second shaft section 14 is also tubular and may, but need not, taper. Both the first and second shaft sections can be made from steel, graphite, fiber glass, or other materials known to those skilled in the art. For example, steel tubing that has an outer diameter of about 0.58 inches and that has a wall thickness of about 0.010 to 0.015 inches can be used. The shaft sections 12, 14 need not have the same diameter either; one shaft section can have a smaller diameter or have tubular portion that has a smaller diameter and that is stepped down from the rest of that shaft section. Also, the shaft sections can comprise any of a number of prefabricated shaft models made by numerous manufacturers, e.g., Apollo, and are available from common sources known to those in the art. The wrapped portion of the first shaft section then becomes a lower grip 22 and the wrapped second shaft section then becomes an upper grip 24. The lengths of the shaft sections 12, 14 are not critical, and those skilled in the art can select suitable lengths. The lengths will depend on many factors, including the height of the golfer, the size of the golfer's palm, and whether the putter is to be used while the golfer is standing or while in a more conventional bent over position. However, suitable lengths are about 4.5 to 5.5 inches for the upper grip 24 and about 18 inches for the entire wrapped grip portion.

Figure 4B:
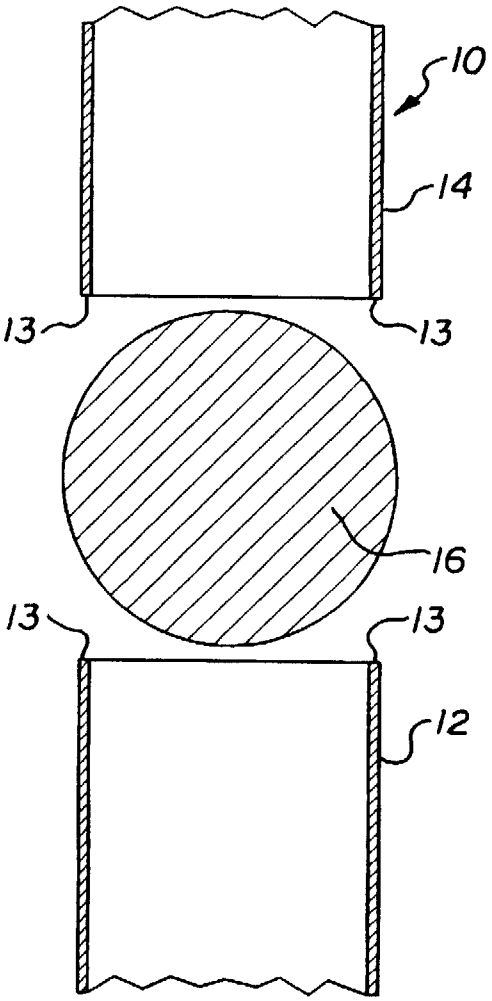
FIG. 4B is an exploded view of FIG. 4A, showing the first and second shaft sections and the pivot piece.
Figure 4A:
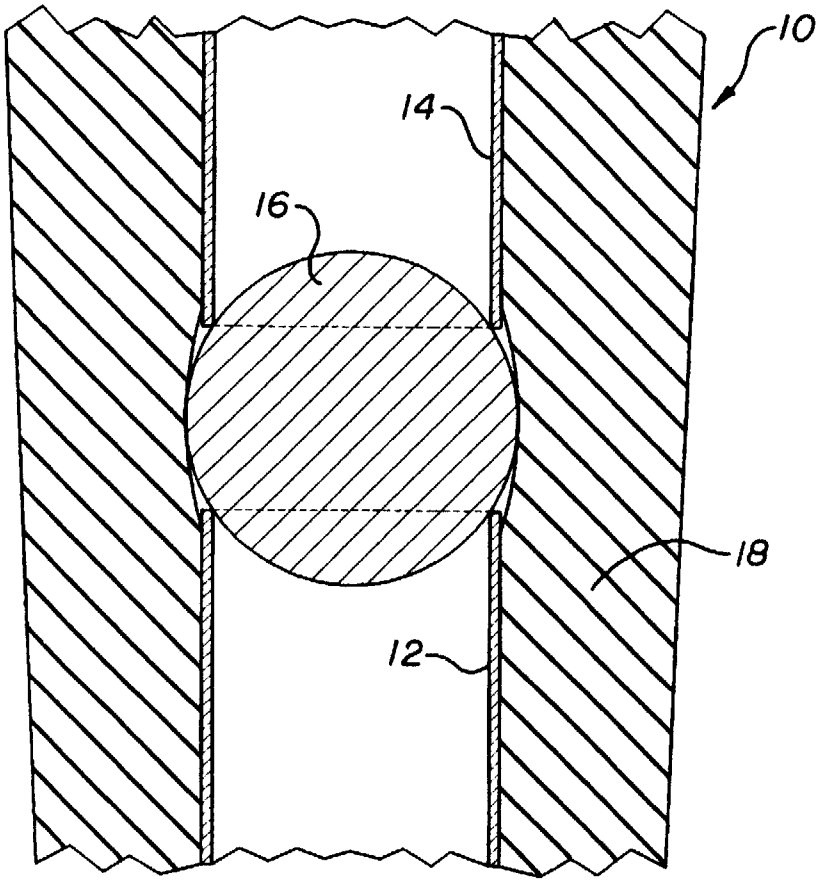
FIG. 4A is a fragmentary, very detailed, cross sectional view of the articulated pendulum putter according to showing the first and second shaft sections, the pivot piece, and the grip.
Figure 5B:
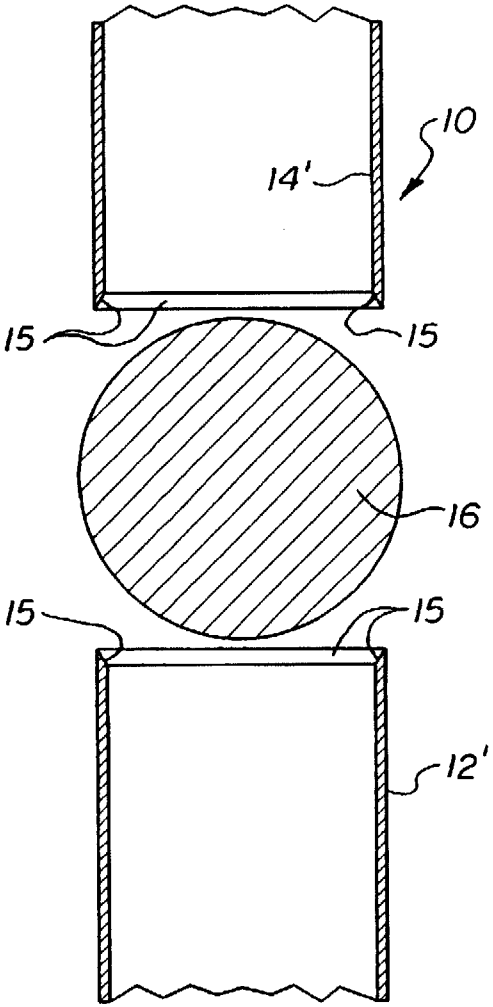
FIG. 5B is an exploded view of FIG. 5A, showing the first and second shaft sections and the pivot piece.
Figure 5A:
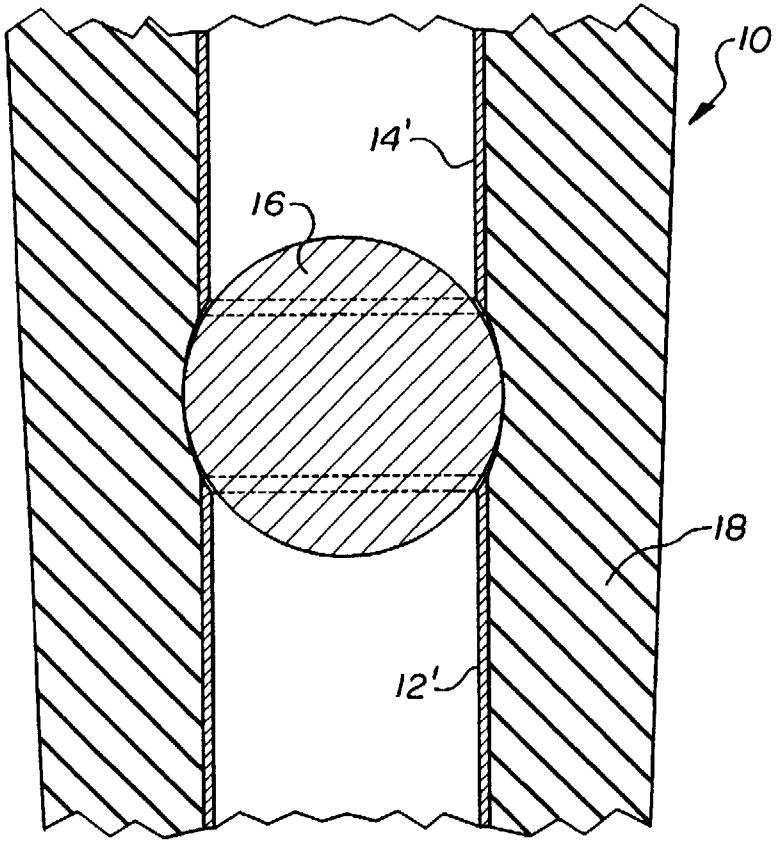
FIG. 5A shows alternative shaft sections similar to the view of FIG. 4A.
Figure 6:
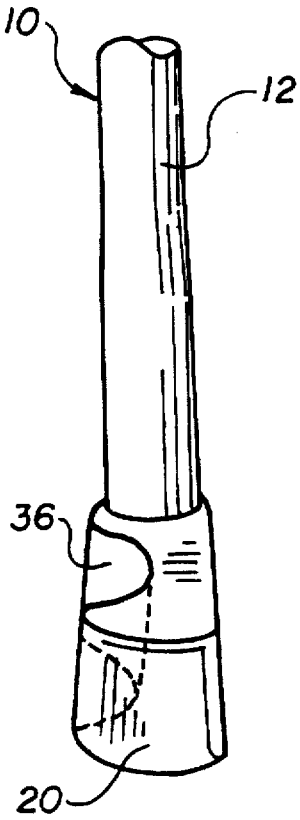
FIG. 6 is a fragmentary, front perspective view of the lower end of the putter of the present invention.
Figure 7:
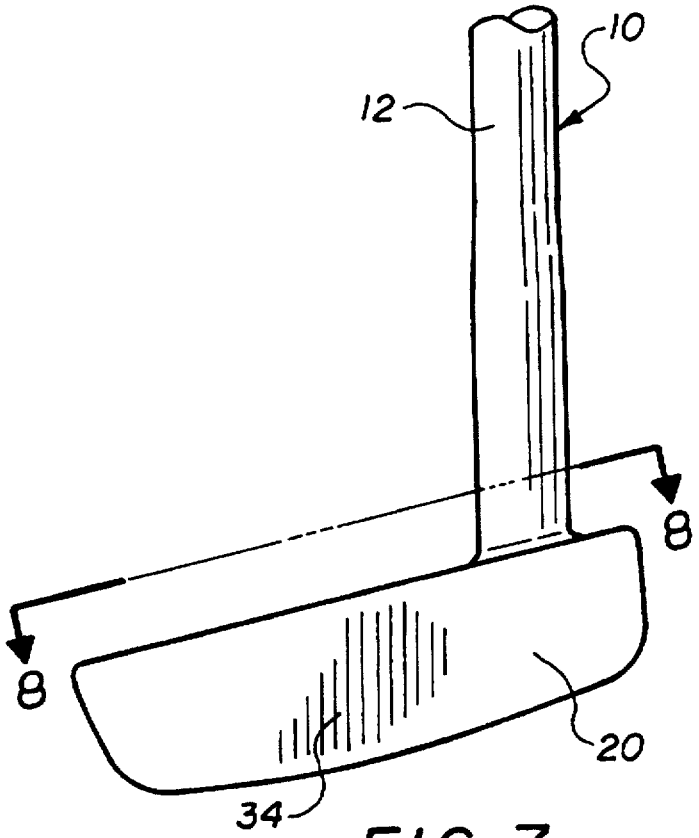
FIG. 7 is a fragmentary, side elevational view of the putter lower end as seen from the right side of FIG. 6.
Figure 8:
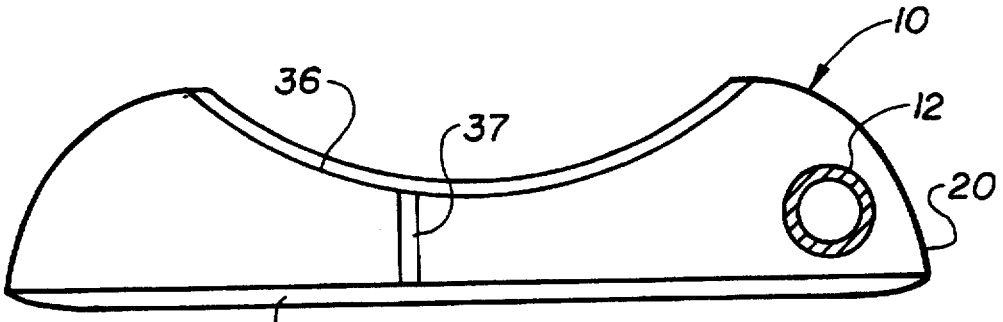
FIG. 8 is a fragmentary vertical sectional view taken substantially along a plane indicated by the section line 8—8 of FIG. 7.

FIGS. 4A and 4B show shaft sections 12, 14 having contact surfaces 13 that are perpendicular to the longitudinal axes of the shaft sections 12, 14 as would result from merely cutting and finishing the shaft sections 12, 14. FIGS. 5A and 5B show alternative shaft sections 12', 14' having contact surfaces 15 that are beveled inward toward the pivot piece 16 with respect to the longitudinal axes of the shaft sections 12', 14' as would result from cutting the shaft sections 12, 14, cutting or reaming a 45° break edge, i.e., contact surfaces 15, and then finishing the shaft sections 12', 14'. The resulting contact surfaces 15 are approximately parallel to the contact points of the pivot piece 16.

The pivot piece 16 is preferably in sliding operative engagement with both the first shaft section 12 and the second shaft section 14, but need not be so. In the alternative, the pivot piece 16 can be rigidly affixed to or formed integrally with one of the shaft sections (not shown) and in sliding operative engagement with the other shaft section. Preferably the pivot piece 16 is spherical; however, what is important is that the pivot piece 16 have a surface that allows pivoting movement of the first shaft section 12 relative to the second shaft section 14. For example, as long as the pivot piece has surface(s) that are zones of a sphere, the proper movement of the two shafts will result, with a "zone of a sphere" being the portion of the surface of a sphere included between two parallel planes. Other shapes are possible.

The pivot piece 16 can be made from chrome-plated aluminum or any other hard material that has a relatively low coefficient of friction with respect to whatever material the first and second shaft sections 12, 14 are made from. One suitable pivot piece 16 is a common chrome-plated solid aluminum ball bearing. If the pivot piece 16 is a sphere, it is important that the pivot piece 16 have a diameter of at least about 0.025 inches larger than the inner diameter of the shaft sections 12, 14, which allows adequate pivoting motion of the shaft sections 12, 14. For example, if a tube as described above (0.58" OD and 0.010 or 0.015" thick) is used, then a sphere that is about 0.610 inches in outer diameter can be used. The exact materials comprising the pivot piece 16 are not critical, except the chosen materials must be strong enough to withstand the forces felt during use and the friction between the shaft portions 12, 14 and the pivot piece 16 must be low enough to allow easy pivoting of the lower grip 22 with respect to the upper grip 24 without requiring a force so large as to negatively affect the putt. In general, the pivot piece 16 should be as light as practicable; thus, it may be desirable to use a hollow pivot piece or a pivot piece made of a soft, light material (e.g., aluminum) that is coated with a smooth, harder material (e.g., chrome).

Preferably the pivot piece 16 is in direct sliding contact with the surfaces 13 or 15 of the shaft sections 12, 14. However, in the alternative, an applied coating or solid piece that is essentially an extension of the shaft sections 12, 14, e.g., a thin, solid piece (not shown) inserted between the surfaces 13 or 15 and the pivot piece 16, can be used. The presence of that piece disposed therebetween still allows the shaft sections to be in "sliding operative engagement" with the pivot piece, as that term is used herein.

The wrap 18 preferably consists of a standard grip. Suitable grips are available from numerous sources, including Royal Grip Co., of Arizona. Due to the longitudinal length of the grip 18, two or more separate grips might need to be used to fully cover the second shaft section 14, the pivot piece 16, and the desired length of the upper part of the first shaft section 12. The grip 18 preferably has an integral end cap 48 made of the same material as and integral with the grip 18. In the alternative, the grip 18 does not have an integral end cap 48, rather that end of the grip 18 ends flush with the end of the second shaft section 14. In that case, the end of the grip 18 is optionally capped with an upper end cap (not shown). Also, the other end 50 of the wrap 18 can be capped with an optional lower end cap (not shown). The optional upper end cap can be made of metal and can have a narrow cylindrical portion that is inserted into the uppermost end of the second shaft section 14 until it is flush with the uppermost end of the grip 18, and a wide cylindrical portion that is the diameter of the grip 18 that covers the exposed end of the wrap 18. The optional lower end cap can also be made of metal and is placed over a stepped down portion of the grip 18. Both end caps can be held in place with friction or any suitable adhesive.

Securing the grip 18 around the shaft sections 12, 14 and the pivot piece 16 is similar in many respects to securing a grip to any putter shaft. Generally, as known to those skilled in the art, double-sided grip tape is wound around the portion of the shaft to be covered by the grip. The grip tape comes in several forms, e.g., on a spool or in precut lengths. A solvent, e.g., paint thinner, gasoline, or any of the special volatile solvents made specifically for the task of inserting grips into shafts, is used to lubricate the shaft before insertion into the grip. With the taped portion of the grip lubricated and the inside of the grip lubricated, the shaft is quickly inserted into the grip. As the solvent evaporates, the grip tape contacts the shaft and the grip, thereby securing the grip to the shaft.

During fabrication of the putter 10 of the present invention, the shaft sections 12, 14 are cut to appropriate lengths. This can take the form of cutting a prefabricated shaft into two pieces of appropriate lengths. If desired, break edges 15 are cut or reamed into the end(s) of the shaft section(s) 12, 14 that will be in sliding contact with the pivot piece 16. Finally, the ends of the shaft section(s) 12, 14 are finished. Next, double-sided grip tape (not shown) is secured to substantially all of the second shaft section 14, leaving about one-sixteenth or one-eighth of an inch from both ends untaped. Next, the inside of the grip 18 and the taped portion of the second section 14 are lubricated with the volatile solvent, as known to those in the art. Immediately, the lubricated second shaft section 14 is inserted into the end 50 of the grip 18 and pushed in until it reaches the end 48 of the grip 18. A long rod (not shown) of significantly smaller diameter than the inside diameter of the grip 18 can be used to push the second shaft section 14 deep into the grip 18. If the grip 18 does not have an integral end cap 48, then the second shaft section 14 can be inserted onto the end of the grip 18 where the integral and cap 48 would have been.

After the second shaft section 14 is inserted, the outside of the pivot piece 16 and the inside of the grip 18 are lubricated with the volatile solvent and the pivot piece 16 is immediately inserted into the end 50 of the grip and pushed into contact with the second shaft section 14. Again, the rod can be used to push the pivot piece 16 into the grip 18. Next, the portion of the first shaft section 12 that is to be covered with the grip 18, except for one-sixteenth or one-eighth of an inch at each end of the covered portion, is taped using double-sided grip tape. Finally, the taped portion of the first shaft section 12 and the inside of the of the grip 18 are lubricated with the volatile solvent and the first shaft section is immediately inserted into the end 50 of the grip and pushed into contact with the pivot piece 16. When inserting the first shaft section 12 into the grip, care must be taken to not push the first shaft section 12 with so much force that the shaft sections 12, 14 bind with or damage the pivot piece 16. Preferably only the grip 18 serves to maintain the shaft sections 12, 14 in sliding operative engagement with the pivot piece 16. In the alternative, other wraps can be used to hold the pieces 12, 14, and 16 together. The remaining steps needed to fabricate the putter 10 according to the present invention are known to those of ordinary skill in the art.

The grip 18 is relatively thick and applies forces on the first shaft section 12 relative to the second shaft section 14 that tend to maintain the shaft sections 12, 14 in longitudinal alignment and that tend to prevent twisting of one shaft section relative to the other, despite the fact that the pivot piece would otherwise allow such movement. This has the practical effect of tending to maintain the two shaft sections in relative positions that are helpful during the putt.

The putter head 20 is elongated and projects outwardly from one side of the lower end of the first shaft section 12 and defines an included angle therewith of generally 105°. The front side of the head 20 includes a planar ball striking face 34 disposed at a lift angle of between 2° and 5° and the rear side of the head 20 includes a vertically extending partial semi-cylindrical recess 36 with the central portion of the recess disposed in front-to-rear alignment with the central area of the ball striking face 34. An indicator, such as line 37, is added to provide the golfer with a visual cue to aid the putt.

In operation, the upper grip 24 is gripped in the conventional manner with one hand 40 of a person 42 wishing to perform a putting stroke, while the other hand 44 of the person 42 grips the lower grip 22, also in the conventional manner. The difference from a conventional putter grip is that the two hands 40, 44 must be spaced apart at the location of the pivot piece 16 to allow the grips 22, 24 to pivot relative to one another. In the alternative, a standing position can be used with one hand 40 gripping the upper grip 24 and the other hand 44 gripping the lower grip 22. In either case, while the hand 40 is held stationary, the other hand 44 is used to swing the first shaft section 12 in pendulum fashion about an axis of angular displacement coinciding with a center axis of the pivot piece 16 in order to strike an associated golf ball 46 with the head 20 of the putter 10. The forces put on the first shaft section 12 by the thick, wrapped grip 18 tend to maintain the axis of angular displacement of the lower shaft section 12 stationary relative to the hand 40. Thus, to some degree, the golfer 42 need only be sure that the hand 40 is held stationary while the other hand 44 causes the lower shaft section 12 to swing relative to the hand 40 in pendulum fashion when striking the ball 46 toward the cup.

Finally, the putter 10 of the present invention is "convertible" in the sense that it can optionally be used just like an ordinary putter, without using the articulated grip 24. In this case, both hands 40, 44 of the golfer grip the lower grip 22 and the putter 10 is used in the conventional manner (not shown).

While the present invention has been illustrated by the description of embodiments thereof, and while certain aspects of the present invention have been described in considerable detail, it is not the intention of the applicant to restrict or in any way limit the scope of the appended claims to such detail. Additional advantages and modifications will readily appear to those skilled in the art. For example, other shapes of pivot pieces can be used without affecting the simplicity or action of the putter of the present invention. As another example, the first shaft section 12 can either be one part or be in several parts, with for example one part in sliding operative engagement with the pivot piece 16, the other part physically annexed to the putter head 20, and the two parts physically annexed to each other. As a final example, the pivot piece 16 can be integrally formed details, representative apparatus and method, and illustrative examples shown and described. Accordingly, departures may be made from such details without departing from the spirit or scope of the applicant's general inventive concept.

I claim:

1. An articulated pendulum putter, comprising:

(a) a first shaft section having upper and lower ends, said first shaft section being elongate and carrying a putter head at said lower end;

(b) a second shaft section connected to said first shaft section via a simplified ball joint, said simplified ball joint including a pivot piece, said pivot piece having at least one surface that approximates a zone of a sphere, said at least one surface being in sliding operative engagement with at least one of said first and second shaft sections such that said first and second sections pivot relative to one another; and (c) a wrap covering said pivot piece and at least a portion of said at least one of said first and second shaft sections in sliding operative engagement with said pivot piece, said wrap serving to maintain said pivot piece in sliding operative engagement with said at least one of said first and second shaft sections in sliding operative engagement with said pivot piece; and wherein said pivot piece has substantially the shape of a sphere.

2. An articulated pendulum putter according to claim 1 wherein said pivot piece comprises a sphere.

3. An articulated pendulum putter according to claim 1 wherein said pivot piece comprises a sphere in sliding operative engagement with both said first and second shaft sections.

4. An articulated pendulum putter according to claim 1 wherein said wrap comprises a putter grip.

5. An articulated pendulum putter according to claim 1 wherein said wrap comprises a putter grip covering said upper end of said first shaft section, said pivot piece, and substantially all of said second shaft section.

6. An articulated pendulum putter according to claim 1 wherein said wrap comprises a putter grip directly contacting at least a portion of said pivot piece.

7. An articulated pendulum putter according to claim 1 wherein said wrap comprises a putter grip covering said upper end of said first shaft section, said pivot piece, and substantially all of said second shaft section, and said putter grip directly contacting at least a portion of said pivot piece.

8. An articulated pendulum putter according to claim 1 wherein said pivot piece comprises a chrome-plated aluminum sphere.

9. An articulated pendulum putter according to claim 1 wherein said pivot piece is physically annexed to one of said first and second shaft sections.

10. An articulated pendulum putter according to claim 1 wherein said pivot piece is formed as an integral part of one of said first and second shaft sections.

11. An articulated pendulum putter according to claim 1 wherein said at least one of said first and second shaft sections in sliding operative engagement with said pivot piece comprises a tubular member in sliding operative engagement with said pivot piece.

12. An articulated pendulum putter according to claim 11 wherein a surface of an end of said tubular member in sliding operative engagement with said pivot piece is beveled inward to be about parallel to an engagement surface of said pivot piece.

13. An articulated pendulum putter according to claim 11 wherein said pivot piece is in direct sliding contact with said tubular member.

14. An articulated pendulum putter according to claim 1 wherein said pivot piece is in direct sliding contact with said at least one of said first and second shaft sections in sliding operative engagement with said pivot piece.

15. An articulated pendulum putter, comprising:

(a) a first shaft section having upper and lower ends, said first shaft section being elongate and carrying a putter head at said lower end;

(b) a second shaft section connected to said first shaft section via a simplified ball joint, said simplified ball joint including a pivot piece, said pivot piece having at least one surface that approximates a zone of a sphere, said at least one surface being in sliding operative engagement with at least one of said first and second shaft sections such that said first and second sections pivot relative to one another; and (c) a wrap covering said pivot piece and at least a portion of said at least one of said first and second shaft sections in sliding operative engagement with said pivot piece, said wrap serving to maintain said pivot piece in sliding operative engagement with said at least one of said first and second shaft sections in sliding operative engagement with said pivot piece; and wherein said pivot piece comprises a sphere in sliding operative engagement with both said first and second shaft sections and wherein said first and second shaft sections comprise tubular members, said tubular members being in sliding operative engagement with said sphere.

16. An articulated pendulum putter according to claim 15 wherein surfaces of ends of said tubular members in sliding operative engagement with said pivot piece are beveled inward.

17. An articulated pendulum putter according to claim 15 wherein surfaces of ends of said tubular members in sliding operative engagement with said pivot piece are beveled inward to be about parallel to an engagement surface of said pivot piece.

18. An articulated pendulum putter according to claim 15 wherein said pivot piece is in direct sliding contact with said tubular members.

* * * * *

UNITED STATES PATENT AND TRADEMARK OFFICE

CERTIFICATE OF CORRECTION

PATENT NO. : 5,730,661

DATED : March 24, 1998

INVENTOR(S) : Stanley S. Kozub

Figure 2:
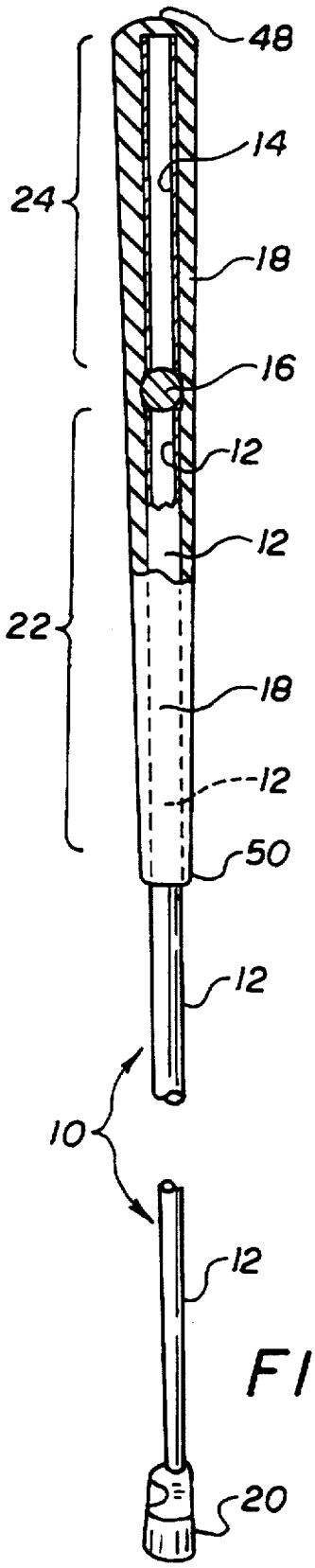
FIG. 2 is a side view of an articulated pendulum putter according to the present invention, the view being partly in section and partly in elevation.
Figure 3:
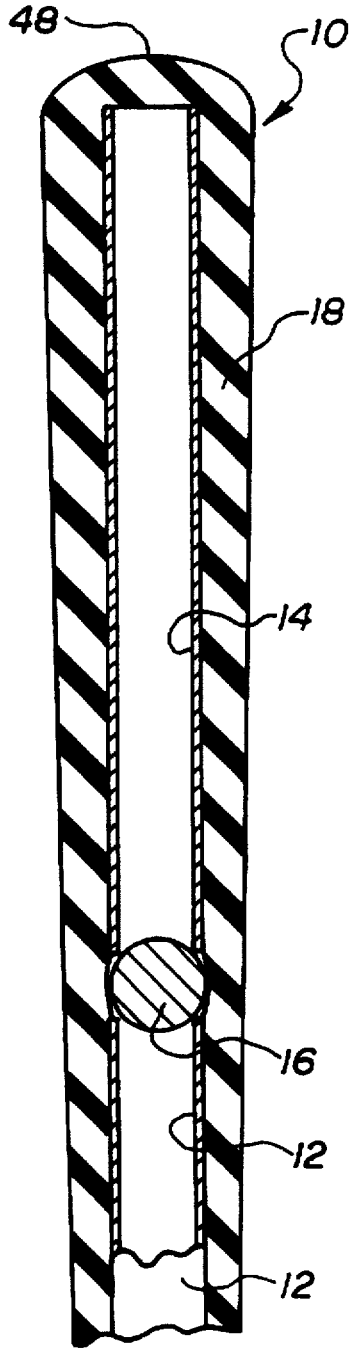
FIG. 3 is a fragmentary, detailed, cross-sectional view of a portion of the articulated pendulum putter according to FIG. 2 showing a preferred pivot piece.

It is certified that error appears in the above-indentified patent and that said Letters Patent is hereby corrected as shown below:

Column 2, line 36, after "to" please add -- Figs. 2 and 3 --.

Column 6, line 33, after "formed" please add -- with one of the shaft sections. Therefore, the invention in its broader aspects is not limited to the specific --.

Signed and Sealed this

Twenty-third Day of June, 1998

Bruce Lehman

*Attest:*

BRUCE LEHMAN

*Attesting Officer*

*Commissioner of Patents and Trademarks*